US008490697B2

(12) United States Patent
Garcia et al.

(10) Patent No.: US 8,490,697 B2
(45) Date of Patent: Jul. 23, 2013

(54) GRAVEL PACK COMPLETIONS IN LATERAL WELLBORES OF OIL AND GAS WELLS

(75) Inventors: Jose F. Garcia, Port-Harcourt (NG); Ian Mickelburgh, West Perth (AU); Jeremie Fould, West Perth (AU); Steve Bissonnette, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 394 days.

(21) Appl. No.: 12/795,260

(22) Filed: Jun. 7, 2010

(65) Prior Publication Data

US 2010/0314109 A1 Dec. 16, 2010

Related U.S. Application Data

(60) Provisional application No. 61/268,756, filed on Jun. 16, 2009.

(51) Int. Cl.
*E21B 43/04* (2006.01)
*E21B 43/10* (2006.01)

(52) U.S. Cl.
USPC ..... 166/278; 166/313; 166/50; 166/51; 166/227

(58) Field of Classification Search
USPC ..... 166/278, 313, 50, 51, 227; 175/62
See application file for complete search history.

(56) References Cited

U.S. PATENT DOCUMENTS 4,540,051 A * 9/1985 Schmuck et al. ..... 166/278
5,113,935 A * 5/1992 Jones et al. ..... 166/51
5,875,847 A 3/1999 Forsyth
6,199,633 B1 3/2001 Longbottom
6,446,729 B1 9/2002 Bixenman
6,752,211 B2 * 6/2004 Dewey et al. ..... 166/313
7,373,989 B2 5/2008 Setterberg
2002/0148607 A1 * 10/2002 Pabst ..... 166/250.08
2002/0189808 A1 12/2002 Nguyen
2002/0195253 A1 12/2002 Hill
2003/0024700 A1 * 2/2003 Cavender ..... 166/278
2003/0221829 A1 12/2003 Patel
2009/0095471 A1 4/2009 Guignard

OTHER PUBLICATIONS

International Search Report and Written Opinion, Application No. PCT/US2010/037674 filed Jun. 8, 2010, dated Aug. 6, 2010.

International Preliminary Report on Patentability, Application No. PCT/US20101037674 filed Jun. 8, 2010, dated 16 Dec. 16, 2011.

* cited by examiner

*Primary Examiner* — Cathleen Hutchins
(74) *Attorney, Agent, or Firm* — David G. Matthews; Brandon Clark; Robert Van Someren

(57) ABSTRACT

A technique enables an efficient, dependable approach to gravel packing lateral wellbores. The technique employs alternate path gravel placement technology which includes alternate path equipment deployed along a gravel pack screen positioned in an open hole lateral wellbore disposed above a lower lateral wellbore. A crossover system is positioned in the lateral wellbore, and the alternate path is provided by connecting a shunt tube or other appropriate alternate path equipment to the crossover system. A flow of gravel slurry is directed along an exterior of the gravel pack screen through the alternate path equipment to enable uniform distribution of the gravel pack along the gravel pack screen.

22 Claims, 14 Drawing Sheets

GRAVEL PACK COMPLETIONS IN LATERAL WELLBORES OF OIL AND GAS WELLS

CROSS-REFERENCE TO RELATED APPLICATION

The present document is based on and claims priority to U.S. Provisional Application Ser. No. 61/268,756, filed Jun. 16, 2009.

BACKGROUND

In many types of oil and gas wells, multilateral well construction and technology can facilitate retrieval of the desired hydrocarbon fluid. Often, the lateral wellbores or legs of such wells are highly deviated, e.g. horizontal. In many applications, the wells are completed in unconsolidated sandstone reservoirs which require completion techniques able to limit or control sand production during a productive life of the well. Due to the challenges presented by the multilateral well architecture, simple single stage downhole sand control often is employed with a stand alone screen assembly. However, many such existing techniques are insufficient in adequately controlling sand and optimizing production.

SUMMARY

In general, the present invention provides a technique for facilitating multilateral well construction by enabling an efficient, dependable approach to gravel packing lateral wellbores. The technique utilizes alternate path gravel placement technology which, in some embodiments, may be used in conjunction with Level 5 multilateral junctions. In one embodiment, a gravel pack screen is deployed into an open hole lateral wellbore disposed above a lower lateral wellbore. A crossover system is positioned in the lateral wellbore, and an alternate path is provided by connecting a shunt tube or other appropriate flow connecting device to the crossover system such that flow of the gravel slurry is directed along an exterior of the gravel pack screen. The gravel slurry is delivered down to the completion equipment located in the open hole lateral wellbore and distributed uniformly via the alternate path.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
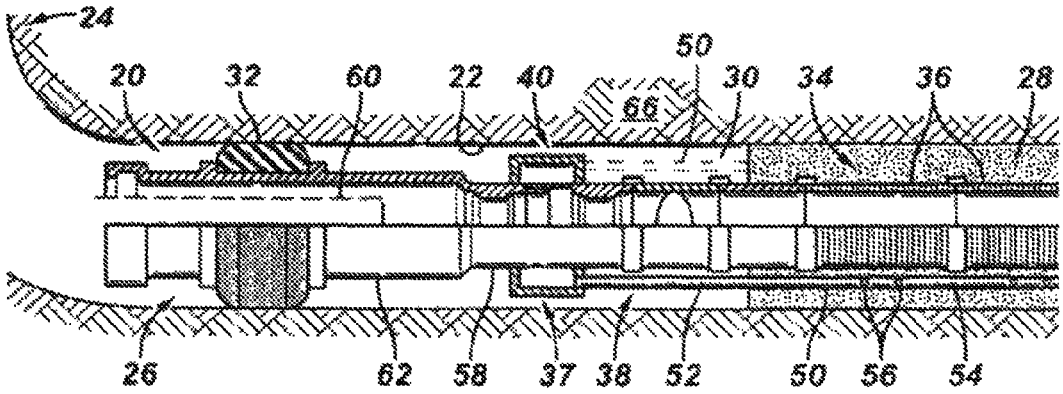
FIG. 1 is a view of one embodiment of a gravel pack completion deployed in an upper lateral wellbore, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and methodology for reliably installing open hole gravel packs in lateral wellbores of multilateral wells. In some embodiments, the technique employs an alternate path gravel placement technology in conjunction with multilateral junctions, such as Level 5 multilateral junctions. The technique enables gravel packing in open hole legs of a multilateral well in a manner which extends the application window of multilateral technologies while increasing the potential for reducing field development related resources.

As discussed in greater detail below, the technique improves gravel packs and ultimately improves production by providing alternate path technology to enable a more complete gravel packing. The more complete gravel packing also facilitates reliable completion of the lateral wellbores and achieves higher production. In one example, the alternate paths are created with shunts which have nozzles and are disposed outside a gravel pack screen assembly. The one or more shunts provide an alternate pathway for gravel slurry to bypass premature bridging and to fill voids, thus resulting in a tight and complete gravel pack in an uncased, e.g. open hole, lateral wellbore. According to one procedure, gravel placement initially proceeds in a standard gravel packing mode until screen out. A pressure buildup occurs after screen out and forces the gravel slurry to flow through shunt tubes and to exit through the nozzles into the first available void. The gravel packing operation continues until all voids are filled and a final screen out occurs. By providing a mechanism able to eliminate voids in the gravel, the final gravel pack is substantially improved.

In some embodiments, a lateral wellbore completion apparatus is provided with a crossover device positioned inside the open hole section of the lateral wellbore. The slurry is directly introduced into the shunt tubes from a service tool via the crossover device, and the slurry is allowed to enter the open hole annulus only from the shunt tubes. With this approach, no pressure buildup external to the gravel pack assembly is required to force the gravel pack slurry along the shunt tubes. Instead, the pressure required to force the slurry through the shunt tubes is maintained within the service tool and screen assembly. As a result, the open hole wellbore does not need to resist slurry placement pressures. Additionally, the crossover device and shunt tubes protect the open wellbore wall from contact with the slurry in a destructive manner. Effectively, the equipment prevents uncontrolled flow of slurry against the surrounding formation of the open wellbore, thus preventing degradation and/or collapse of the lateral wellbore.

Depending on the specifics of a given multilateral application, the gravel packing may be accomplished in a pseudo conventional mode in which the slurry exits the shunt tubes from a shunted blank and travels down the open hole along the screen annulus. Gravel packing in the pseudo conventional mode continues until a bridge to screen out occurs and then slurry is flowed through the shunt tubes and shunt tube nozzles to fill the void spaces. In an alternative approach, the gravel packing may be conducted completely through the shunt tubes. In this latter example, the gravel packing continues until all voids are filled and a final screen out occurs.

Referring generally to FIG. 1, one example of a gravel packing system 20 is illustrated as deployed in a lateral wellbore 22 of a multilateral well 24. In this embodiment, the gravel packing system 20 comprises a lateral wellbore completion apparatus 26 which is used to establish a uniform, reliable gravel pack 28 in an annulus 30 surrounding at least a portion of the lateral wellbore completion 26. As described in greater detail below, the lateral wellbore 22 is an upper lateral wellbore of the multilateral well 24.

As illustrated, the lateral wellbore completion 26 comprises a variety of components designed to facilitate application of the uniform gravel pack 28 without voids in an open lateral wellbore. For example, wellbore completion 26 comprises an open hole packer 32 which may be expanded against the surrounding wall of open hole lateral wellbore 22 to isolate annulus 30. Wellbore completion 26 also comprises a screen section 34 formed of one or more individual screens 36 disposed in the region to receive gravel pack 28. Between open hole packer 32 and screen section 34, various components may be positioned to facilitate creation of the alternate path for directing gravel slurry.

Figure 2:
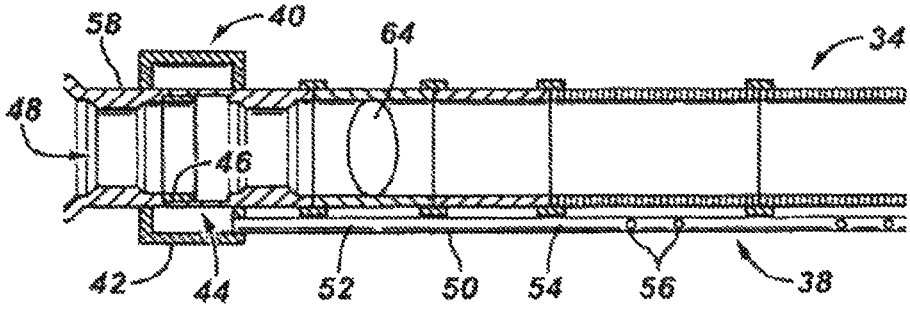
FIG. 2 is an enlarged portion of the gravel pack completion illustrated in FIG. 1, according to an embodiment of the present invention.

For example, a crossover system 37 is employed to direct slurry from an interior of lateral wellbore completion 26 to an alternate path system 38 and ultimately into the surrounding annulus 30. The crossover system 37 may be constructed in a variety of forms, but the illustrated embodiment comprises a shrouded circulating housing 40. As further illustrated in FIG. 2, the shrouded circulating housing 40 comprises a shroud 42 and a flow control device 44, such as a port closure sleeve mechanism 46. The sliding sleeve mechanism 46 may be controlled to selectively allow flow of gravel slurry from an interior flow area 48 of lateral wellbore completion 26 into shroud 42. From the interior of shroud 42, the gravel slurry flows into the alternate path system 38 for uniform distribution along annulus 30 around screen section 34.

In the example illustrated, alternate path system 38 comprises one or more shunt tubes 50 which are coupled to shroud 42 of shrouded circulating housing 40. The shunt tubes 50 may be designed to deliver the gravel slurry to the desired gravel pack region by providing a shunted space out tubing section 52 and a shunted blank section 54 with nozzles 56. Other components of lateral wellbore completion 26 may comprise a polished bore receptacle 58 positioned adjacent the shrouded circulating housing 40 to receive an appropriate gravel pack service tool 60 which may be selectively moved into the wellbore completion 26 to deliver the gravel slurry. A blank pipe section 62 may be disposed between open hole packer 32 and polished bore receptacle 58. Additionally, a large bore flapper valve 64, or another suitable valve, may be positioned in the interior flow area 48 of wellbore completion 26 between shroud 42 and screen section 34. The large bore flapper valve 64 is selectively activated to control the flow of fluid along the interior flow area 48. For example, the flapper valve 64 is used to facilitate flow of gravel slurry into the shunt tubes 50.

Alternate and/or additional components may be incorporated into lateral wellbore completion 26 depending on the parameters of a given gravel packing operation and the environment in which the gravel pack is formed. However, the design of wellbore completion 26 enables gravel to be placed in the open hole annulus around the screen section 34 without relying on the maintenance of hole and filter cake integrity. Additionally, the design of lateral wellbore completion 26 enables gravel slurry to be forced into the desired gravel pack area through the alternate path system 38 without application of pressure to a surrounding formation 66.

In some embodiments, the shrouded system and a shunted blank may not be necessary. For example, some applications may be employed in which the slurry exits into a protected area where the formation is not exposed to screen out pressure. Such applications may be accomplished with a shroud and regular screen instead of using the illustrated alternate path system. However, the lateral wellbore completion 26 and its incorporated alternate path system 38 are useful in a wide variety of environments and with many gravel packing operations.

Figure 3:
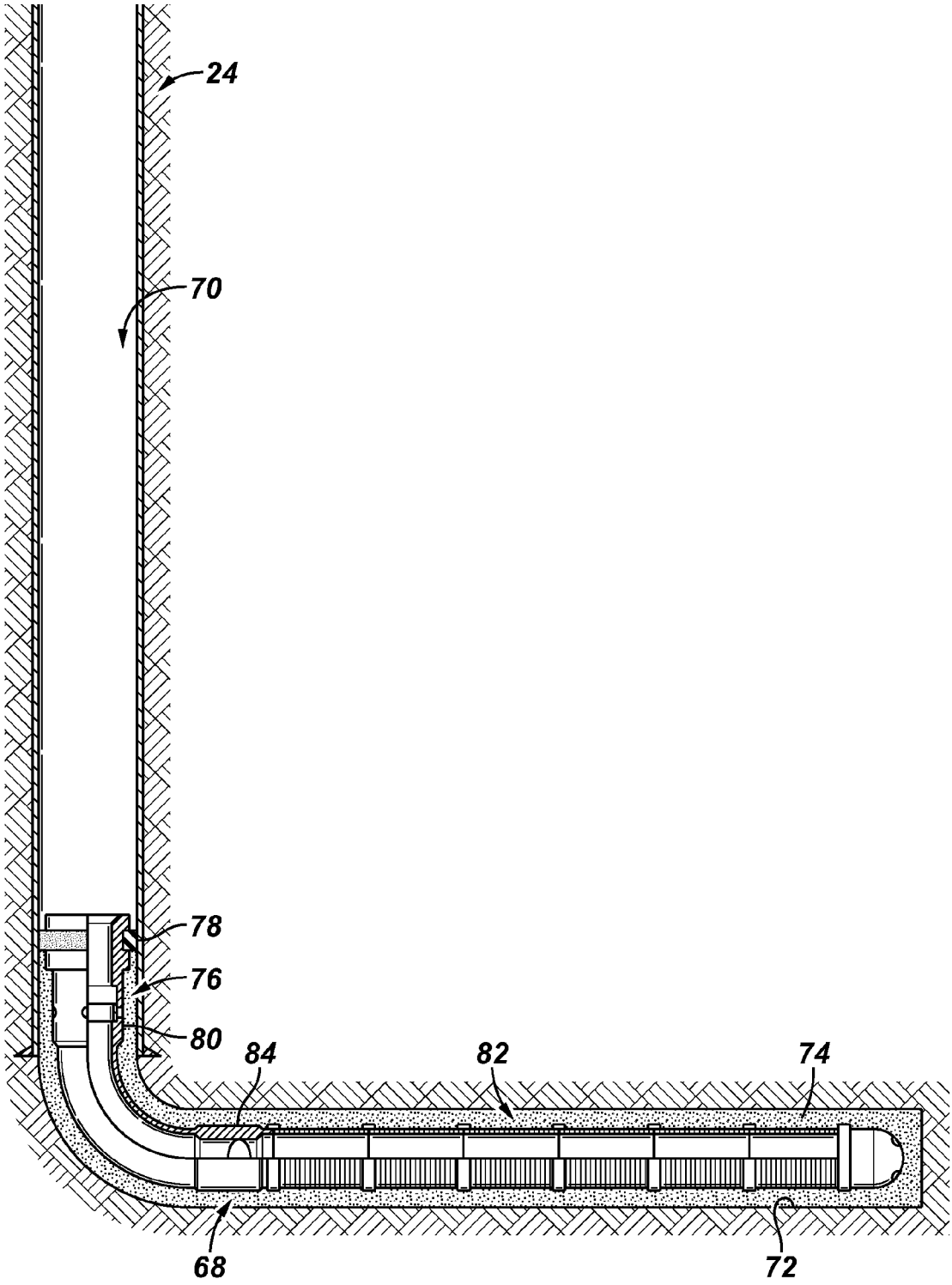
FIG. 3 illustrates an initial phase of a procedure for gravel packing multiple lateral wellbores in a multilateral well, according to an embodiment of the present invention.

In one example of a gravel packing operation employing lateral wellbore completion 26, a lower completion 68 is initially run downhole through a generally vertical, cased wellbore 70 and into a lower lateral wellbore 72, e.g. an open hole lateral wellbore 72, as illustrated in FIG. 3. The lower completion 68 may be run into the multilateral well 24 using a brine fluid or other suitable fluid. Brine may be used as a gravel pack fluid, but oil-based fluids or other suitable fluids also may be used depending on the specific operational requirements. Sometimes, the fluids may be viscosified by using an appropriate viscosifier to help perform the gravel pack and to establish a gravel pack 74 in the lower lateral wellbore 72.

The lower completion 68 may comprise a variety of components, such as a gravel pack assembly 76 having a packer 78 and a port closure sleeve 80 through which slurry may be delivered to form the lower gravel pack 74. Lower completion 68 also may comprise a lower wellbore screen section 82 coupled to an isolation device 84, such as a formation isolation valve. After gravel pack 74 is placed, the formation isolation valve 84 and the port closure sleeve 80 are closed to isolate the lower lateral wellbore 72 at this first zone of interest.

Figure 4:
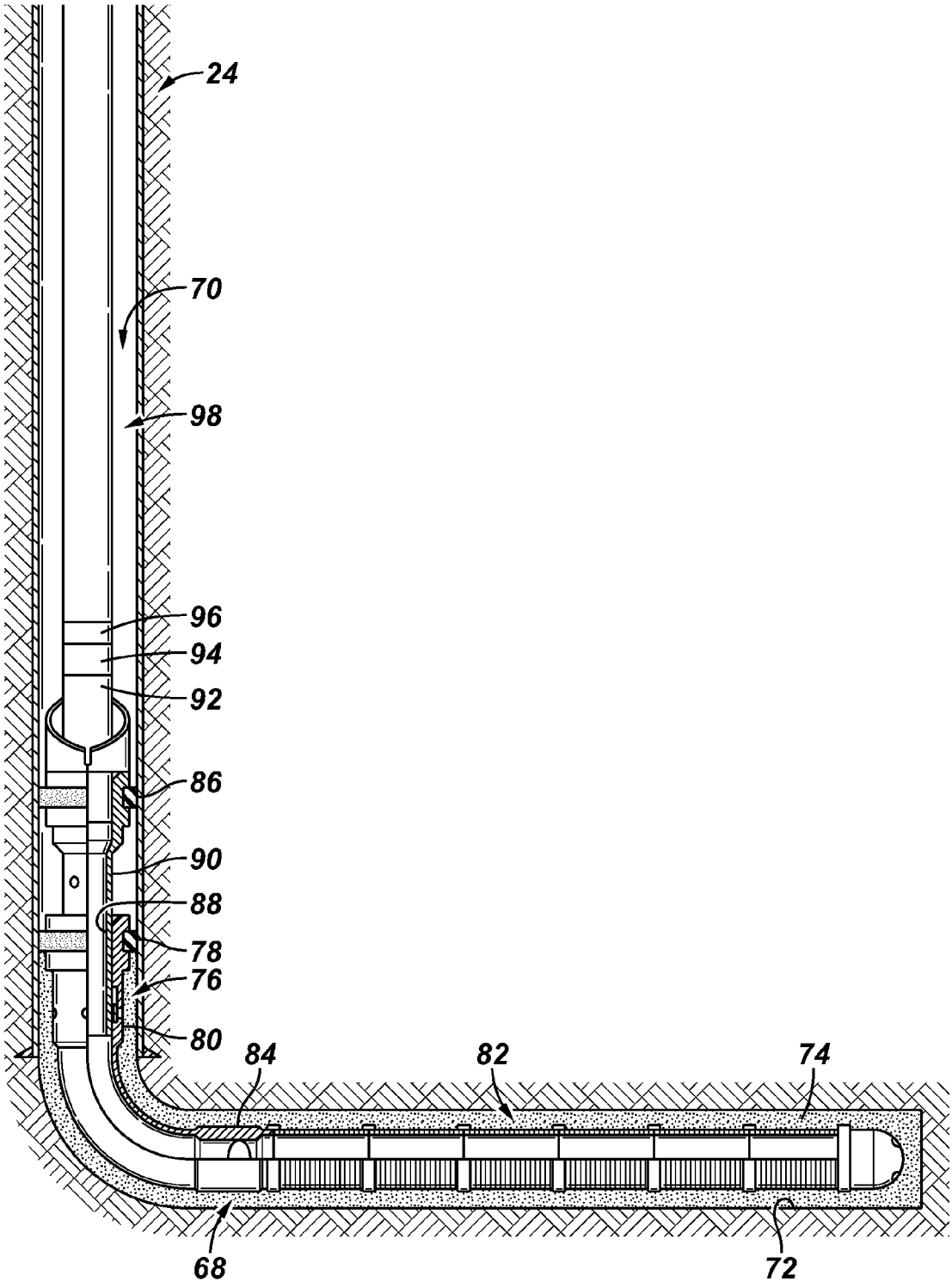
FIG. 4 illustrates a subsequent phase of the gravel packing procedure, according to an embodiment of the present invention.

Subsequently, an anchor packer 86 is run in hole, as illustrated in FIG. 4, and engaged with gravel packer assembly 76 via a seal assembly 88 and a ported sub or sliding sleeve 90. Other components, such as a setting tool 92, a rapid trip saver sub (RTSS) 94, and a measurement while drilling tool 96 also may be run in hole on a suitable tubing string/running tool 98. The anchor packer 86 is then oriented, the rapid trip saver sub 94 is activated, the anchor packer 86 is set, and a pressure test is conducted on the backside of the packer. After successful pressure testing, the running tool 98 is lifted and a pull out of hole (POOH) operation is conducted. It should be noted that a ported sub or sliding sleeve may be required when the formation isolation valve is run as part of the lower completion 68 because it may not be possible to stand into a closed volume without displacing fluid. Additionally, testing of the various seals may be accomplished with appropriate tools. In some applications, the system may be constructed without an anchor packer.

Figure 5:
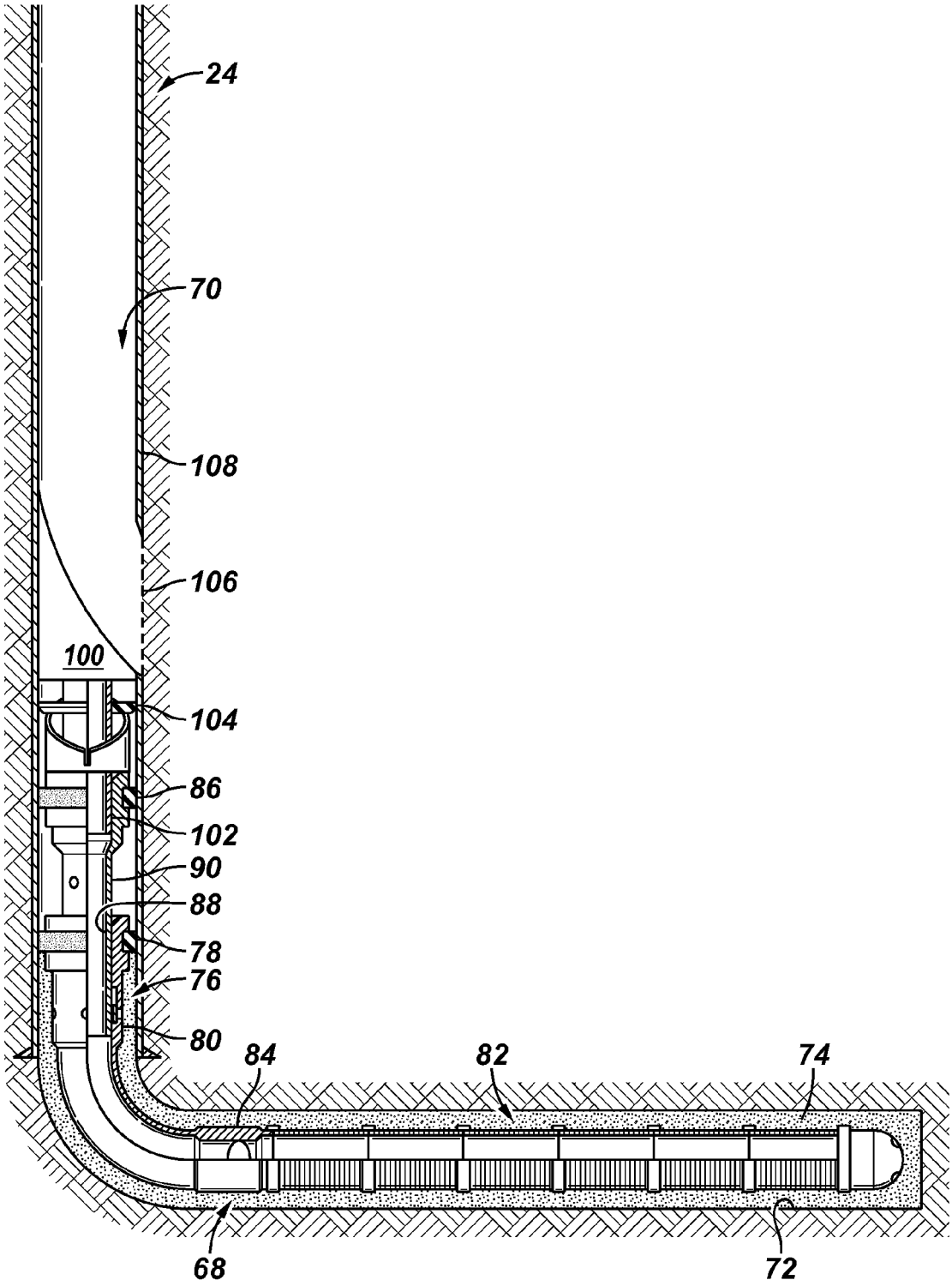
FIG. 5 illustrates a subsequent phase of the gravel packing procedure, according to an embodiment of the present invention.
Figure 6:
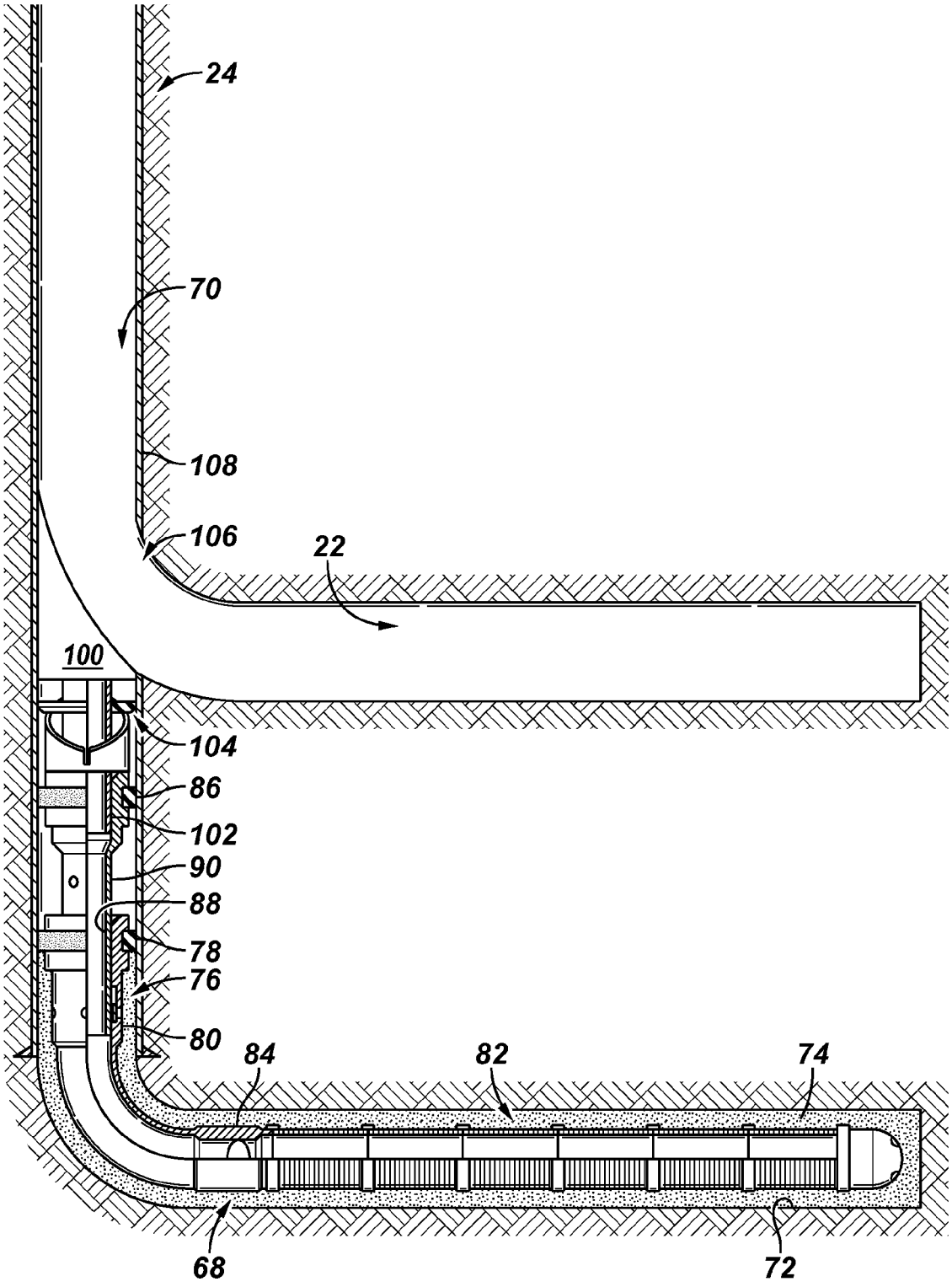
FIG. 6 illustrates a subsequent phase of the gravel packing procedure, according to an embodiment of the present invention.

In a next stage of the procedure, a whipstock 100, a latch 102, and a debris retainer 104 are run in hole and engaged with the anchor packer 86, as illustrated in FIG. 5. Additionally, the measurement while drilling tool 96 may be run in hole via running tool 98 in combination with a mill assembly which is employed to mill a window 106 through a casing 108 which forms the outer wall of the cased wellbore 70. Subsequently, a pull out of hole operation is performed to remove the mill assembly. The window 106 is formed at a location selected for drilling of the upper lateral wellbore 22, as illustrated in FIG. 6. A single upper lateral wellbore 22 is illustrated for purposes of explanation, however additional upper lateral wellbores may be drilled and gravel packed according to the technique described herein.

Figure 7:
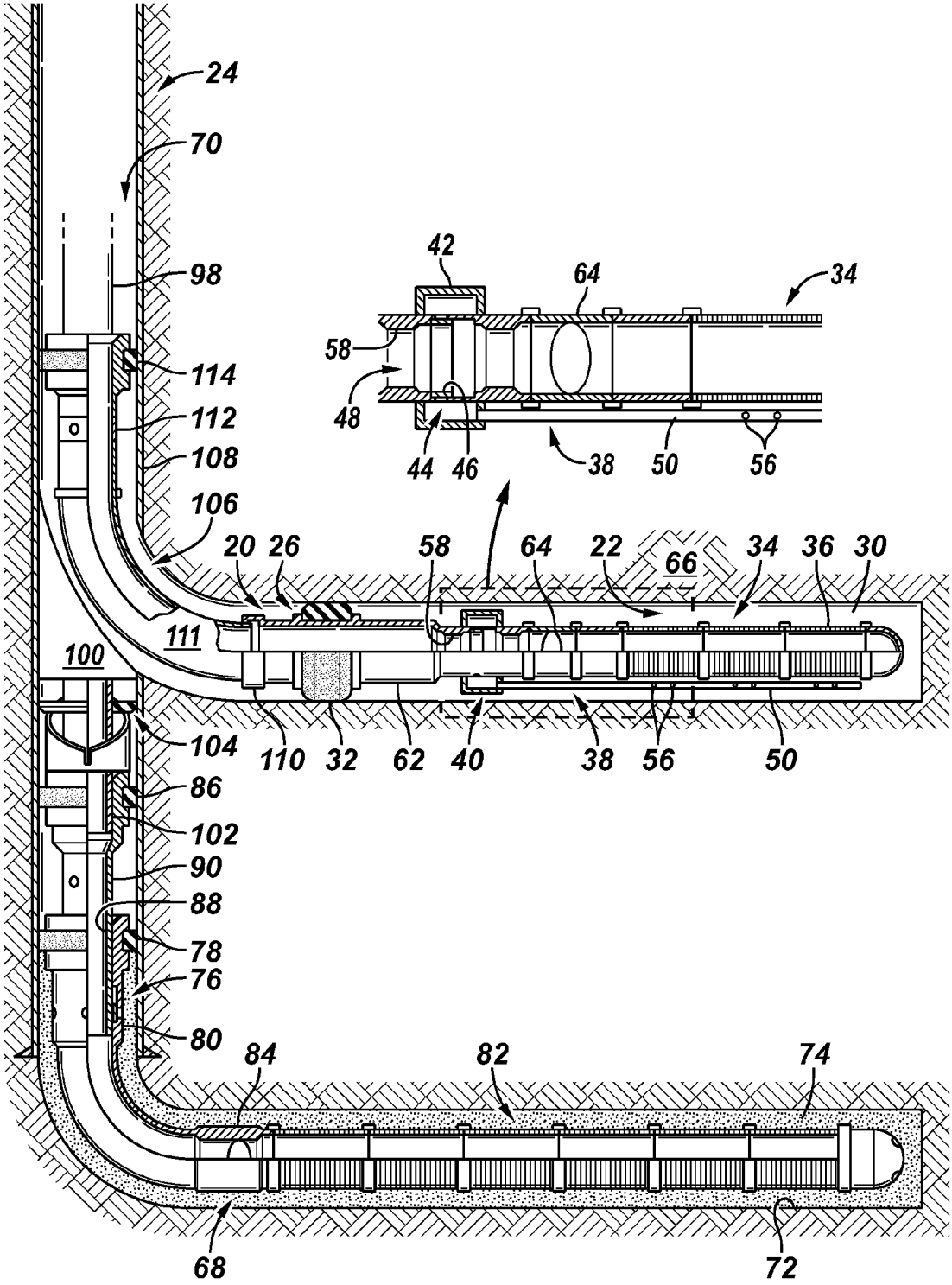
FIG. 7 illustrates a subsequent phase of the gravel packing procedure, according to an embodiment of the present invention.

Referring generally to FIG. 7, the next age of the procedure involves running wellbore completion 26 into the upper lateral wellbore 22. In this example, the lateral wellbore completion 26 is designed as described above with reference to FIGS. 1 and 2. Additionally, annular barrier tools are run downhole for engagement with the completion in upper lateral wellbore 22. For example, a liner disconnect tool 110 in combination with a connector tubing segment 111, a port collar 112 and a scab packer 114 may be run in combination with an inner string incorporating the setting devices for the annular barrier tools. The liner disconnect tool 110, connector 111, port collar 112 and scab packer 114 cooperate to help form the hydraulically sealed connection with the completion components in upper lateral wellbore 22, and this hydraulically sealed connection is referred to as a Level 5 connection. At depth, the scab packer 114 is set, and pressure testing is conducted. The running tool 98 is then released from scab packer 114, the annular barrier tools are activated as necessary, and the running tool 98 is pulled out of hole.

Figure 8:
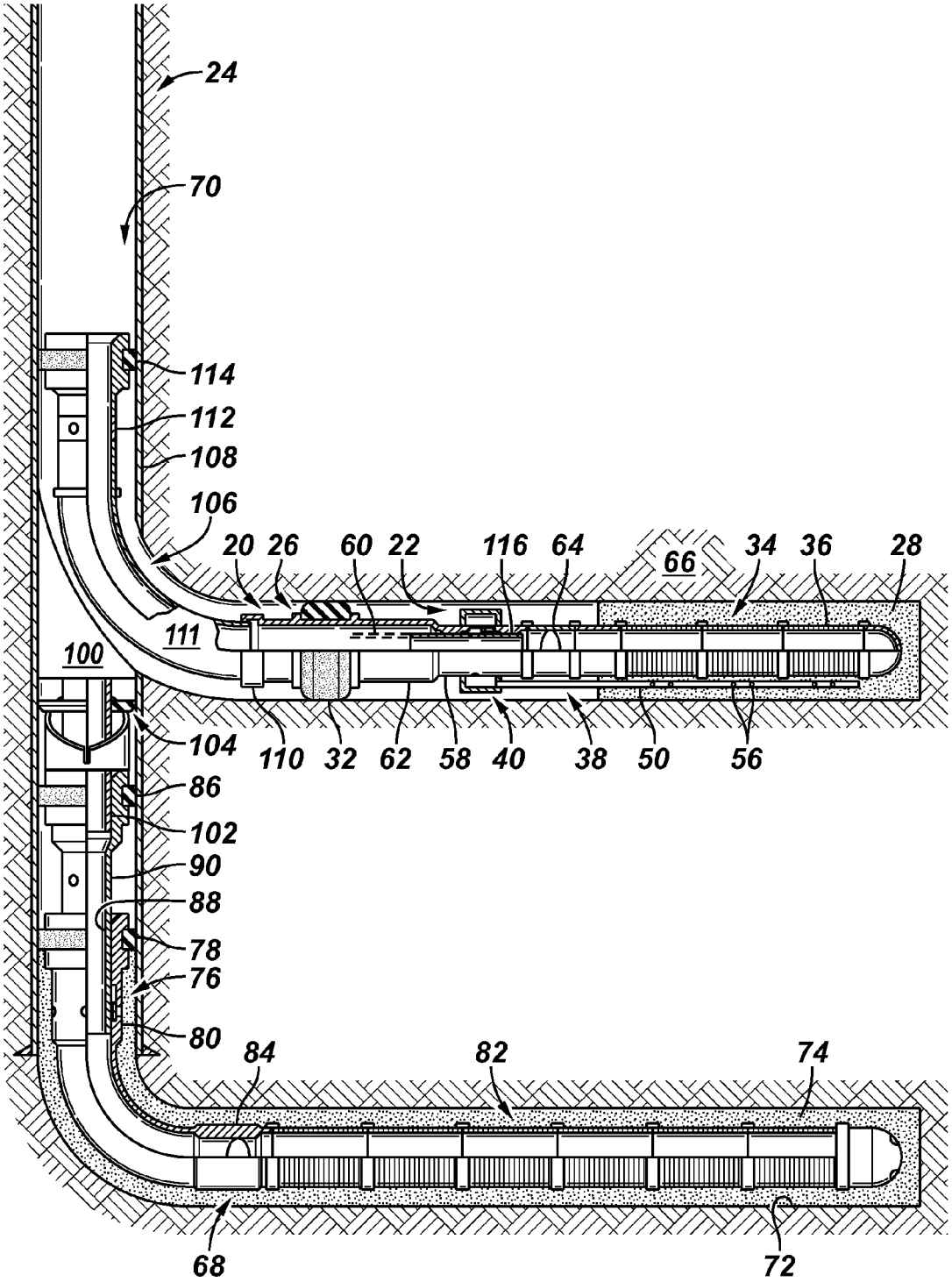
FIG. 8 illustrates a subsequent phase of the gravel packing procedure, according to an embodiment of the present invention.
Figure 9:
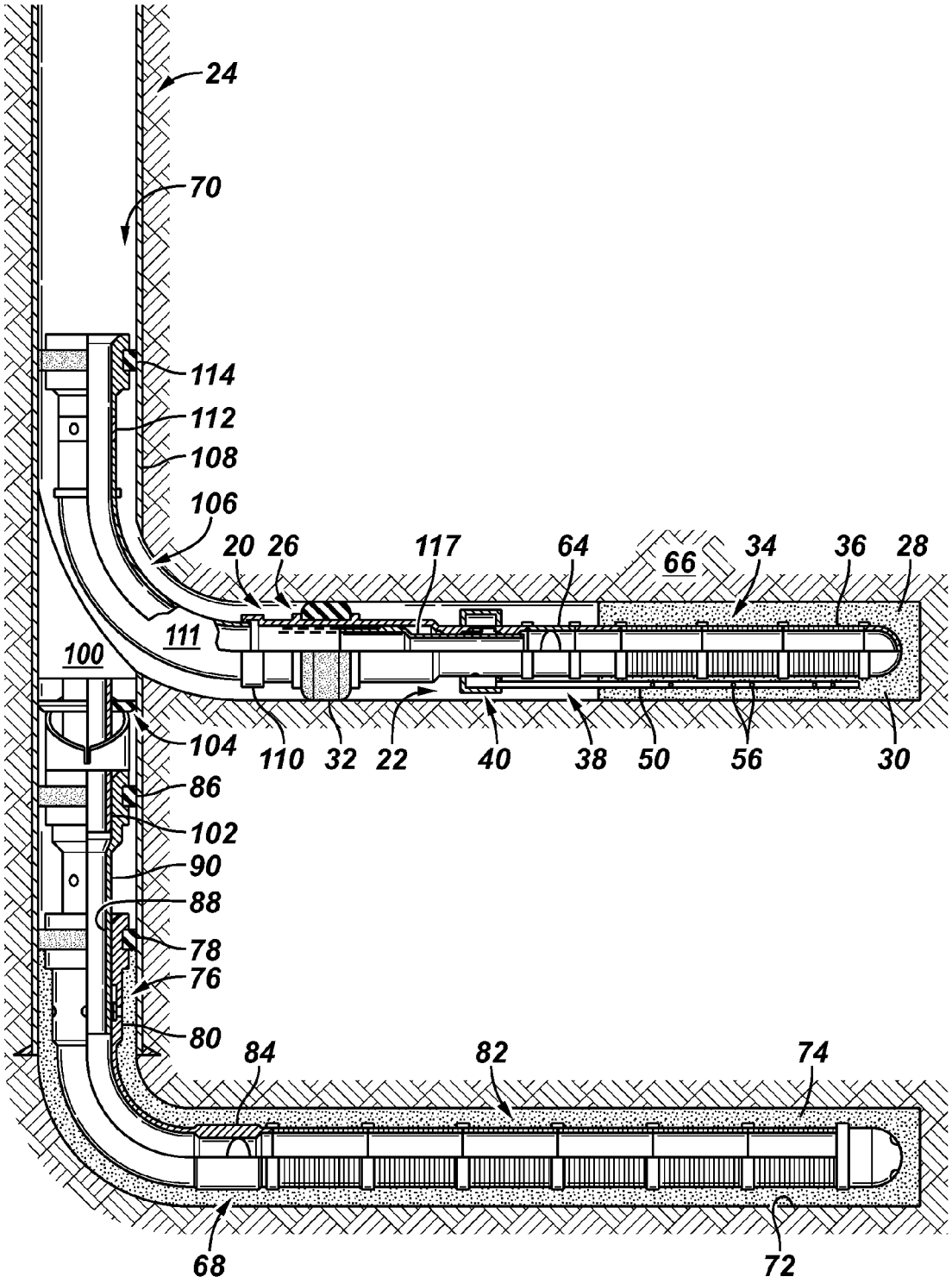
FIG. 9 illustrates a subsequent phase of the gravel packing procedure, according to an embodiment of the present invention.

As illustrated in FIG. 8, a gravel packing operation is then conducted with respect to the upper lateral wellbore 22, and gravel pack 28 is formed in the upper lateral wellbore 22 around screen section 34. On the work string/gravel pack service tool 60, a crossover mandrel, port collar shifting tool, and large bore flapper valve tool are spaced out. At depth, the port collar 112 is closed. A crossover mandrel 116 of gravel pack service tool 60 is positioned inside the port closure sleeve 46, and the gravel slurry is pumped through shunt tubes 50 to form the uniform gravel pack 28. Reverse circulation is then conducted to clean the casing, the port collar 112 is opened, and the service tool 60 is pulled out of hole, as illustrated in FIG. 9. It should be noted that other methods, components and systems may be employed to create the junction with completion 26 in the upper lateral wellbore 22.

As illustrated in FIG. 9, a hydraulic sealing assembly 117 may be employed in the upper lateral wellbore 22 to achieve the hydraulic seal for the lateral tie back. However, in an alternate technique, a seal bore can be run above the annular barrier tools as part of the gravel pack string. To achieve this, a seal assembly, packer, polished bore receptacle, and port collar shifting tool may be run in hole. At depth, the port collar is closed. The packer is landed in such a way that the seal assembly straddles the port closure seal. A ball is then dropped to set the packer. The packer is pressure tested on the back side, and the running tool is released. The port collar is then opened on the way out of hole.

Figure 10:
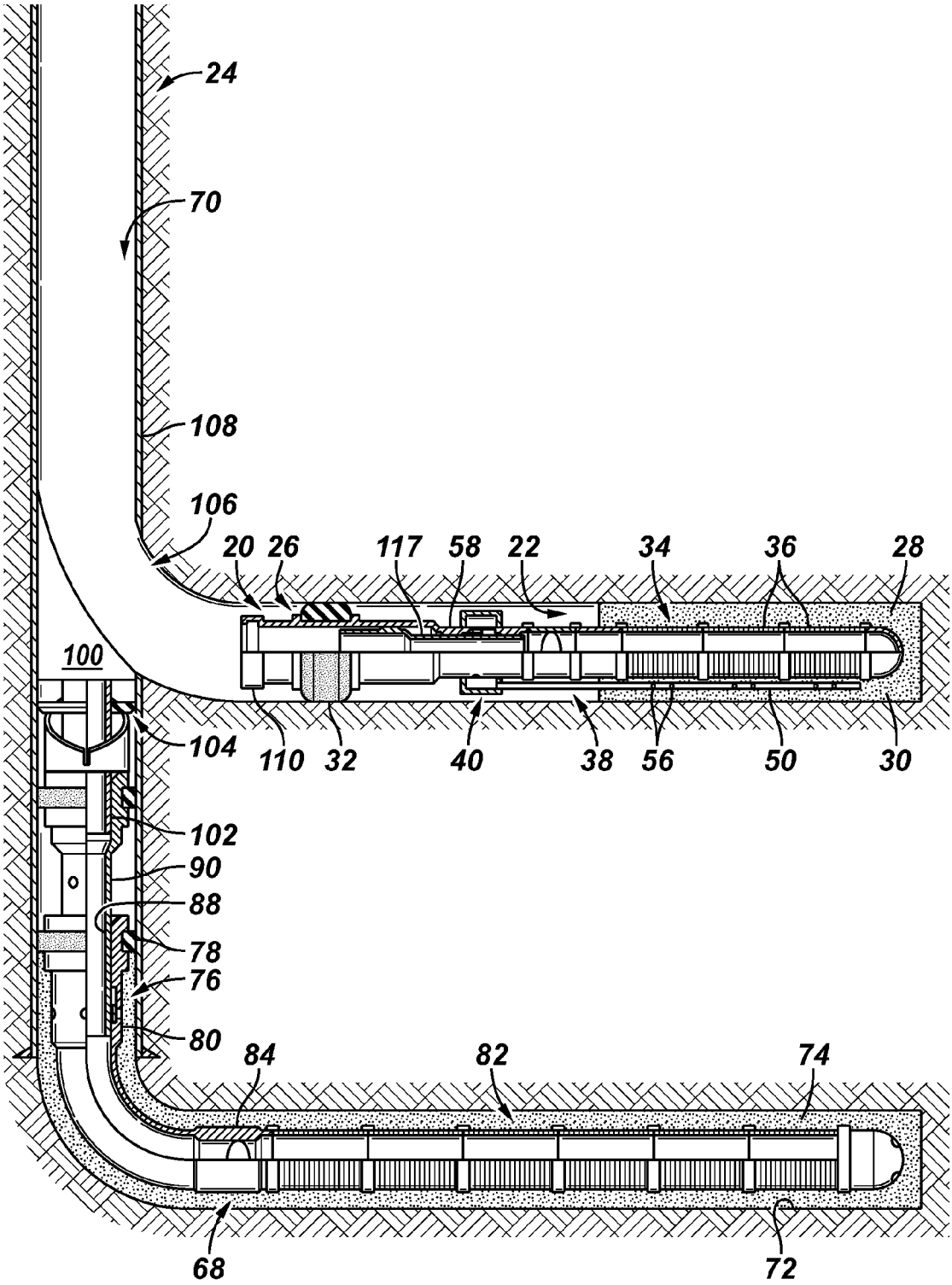
FIG. 10 illustrates a subsequent phase of the gravel packing procedure, according to an embodiment of the present invention.
Figure 11:
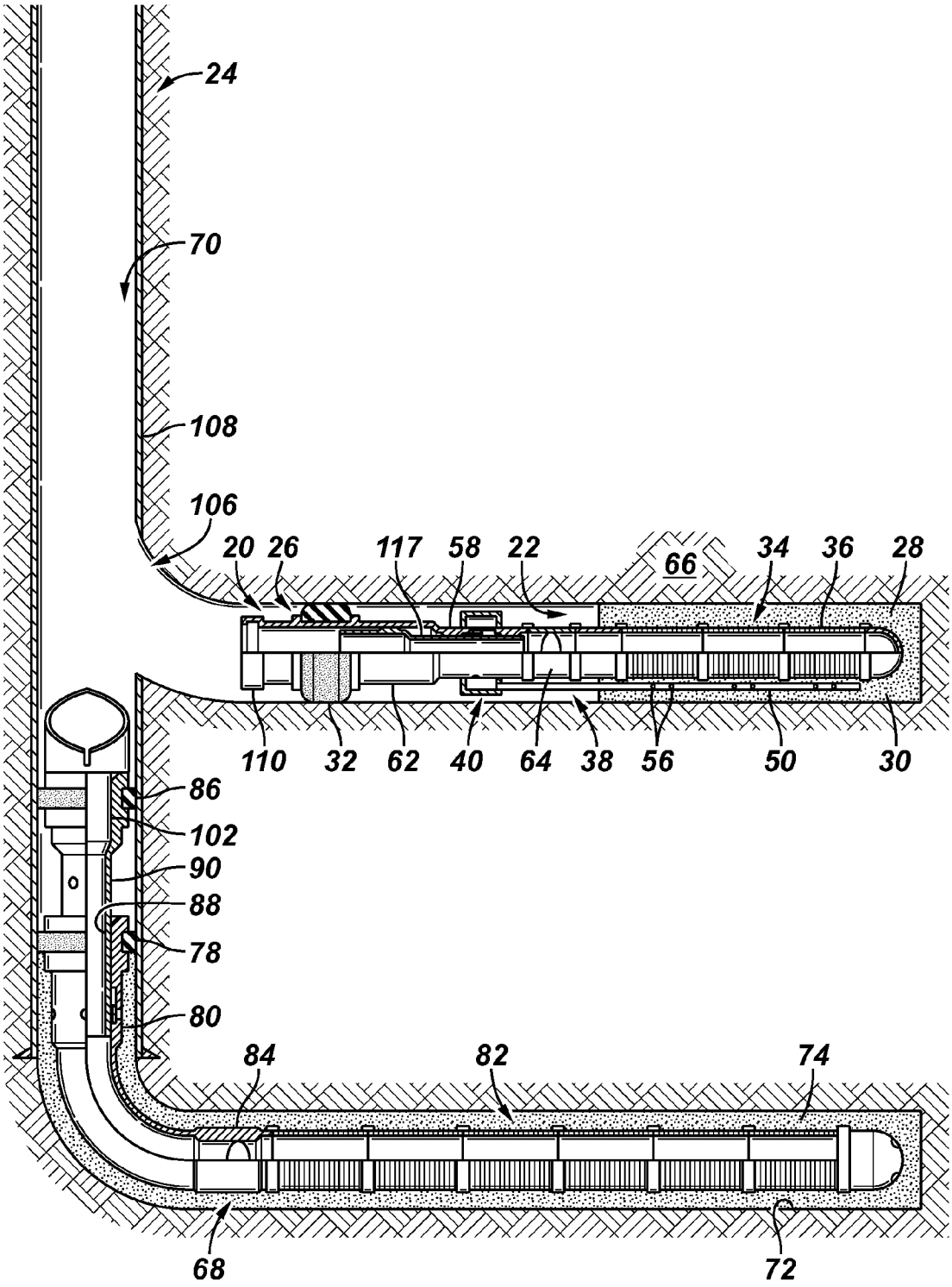
FIG. 11 illustrates a subsequent phase of the gravel packing procedure, according to an embodiment of the present invention.

After placement of gravel pack 28, a LLDT (lateral liner disconnect tool) shifting tool and scab packer retrieving tool are run in hole on, for example, running tool 98. At depth, the LLDT is shifted open, and the scab packer 114 is latched and pulled to release it from the surrounding wellbore wall. As illustrated in FIG. 10, the scab packer 114, port collar 112 and connector 111 may then be separated at the lateral liner disconnect tool 110 and pulled out of hole. Subsequently, running tool 98 may again be employed to remove whipstock 100, as illustrated in FIG. 11. By way of example, a hook may be run with the measurement while drilling tool 96 and engaged with a corresponding hook slot of whipstock 100. Once the hook latches the whipstock 100, the running tool 98 is pulled to release the whipstock and latch, thus enabling a pull out of hole procedure.

Figure 12:
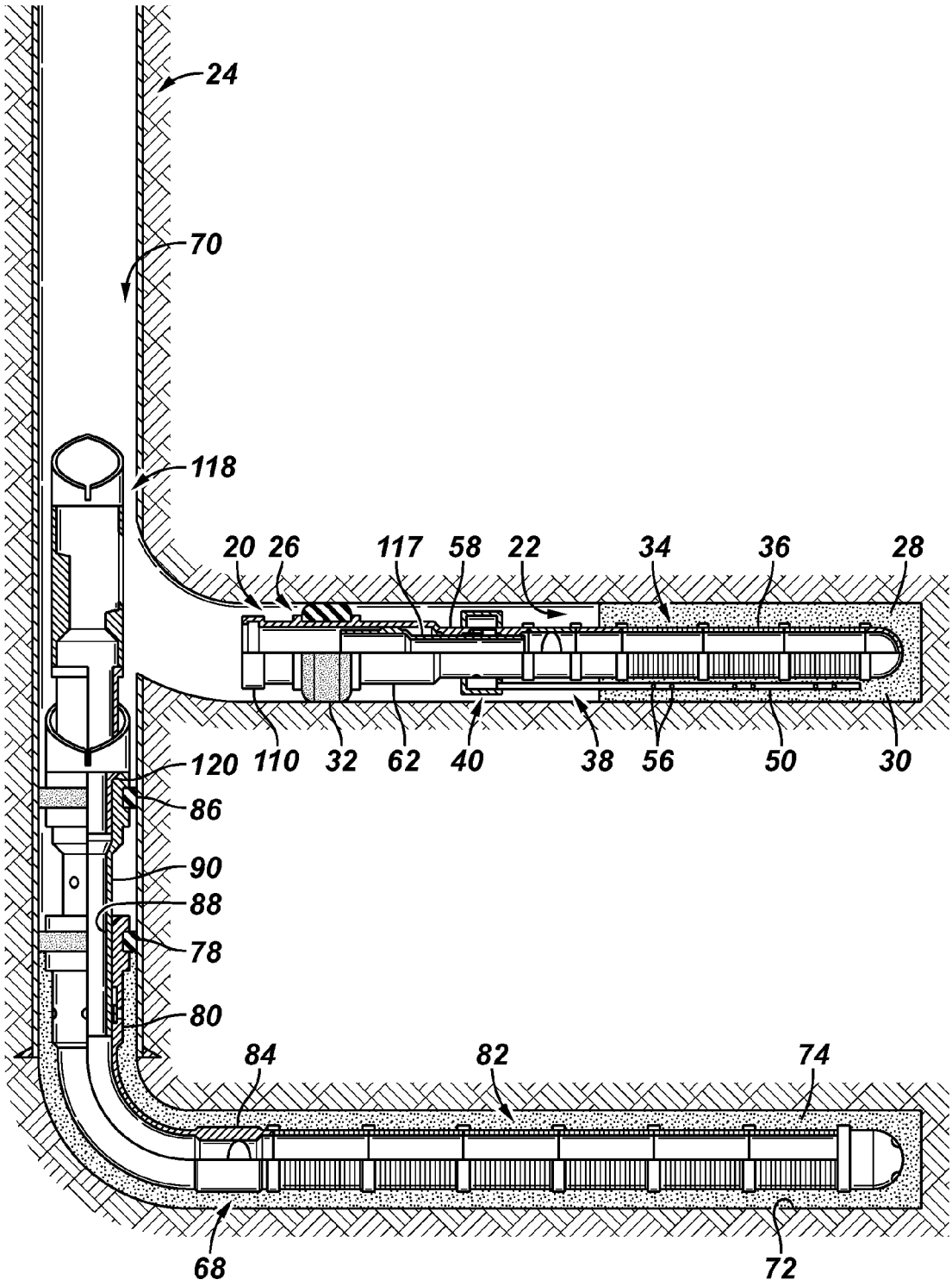
FIG. 12 illustrates a subsequent phase of the gravel packing procedure, according to an embodiment of the present invention.

In a next stage of the overall procedure, a template assembly 118 is run in hole, as illustrated in FIG. 12. The template assembly 118 comprises a latch 120 which is latched with anchor packer 86. After confirming the latch, the running tool 98 is released by, for example, dropping a ball. Once released, the running tool is pulled out of hole.

Figure 13:
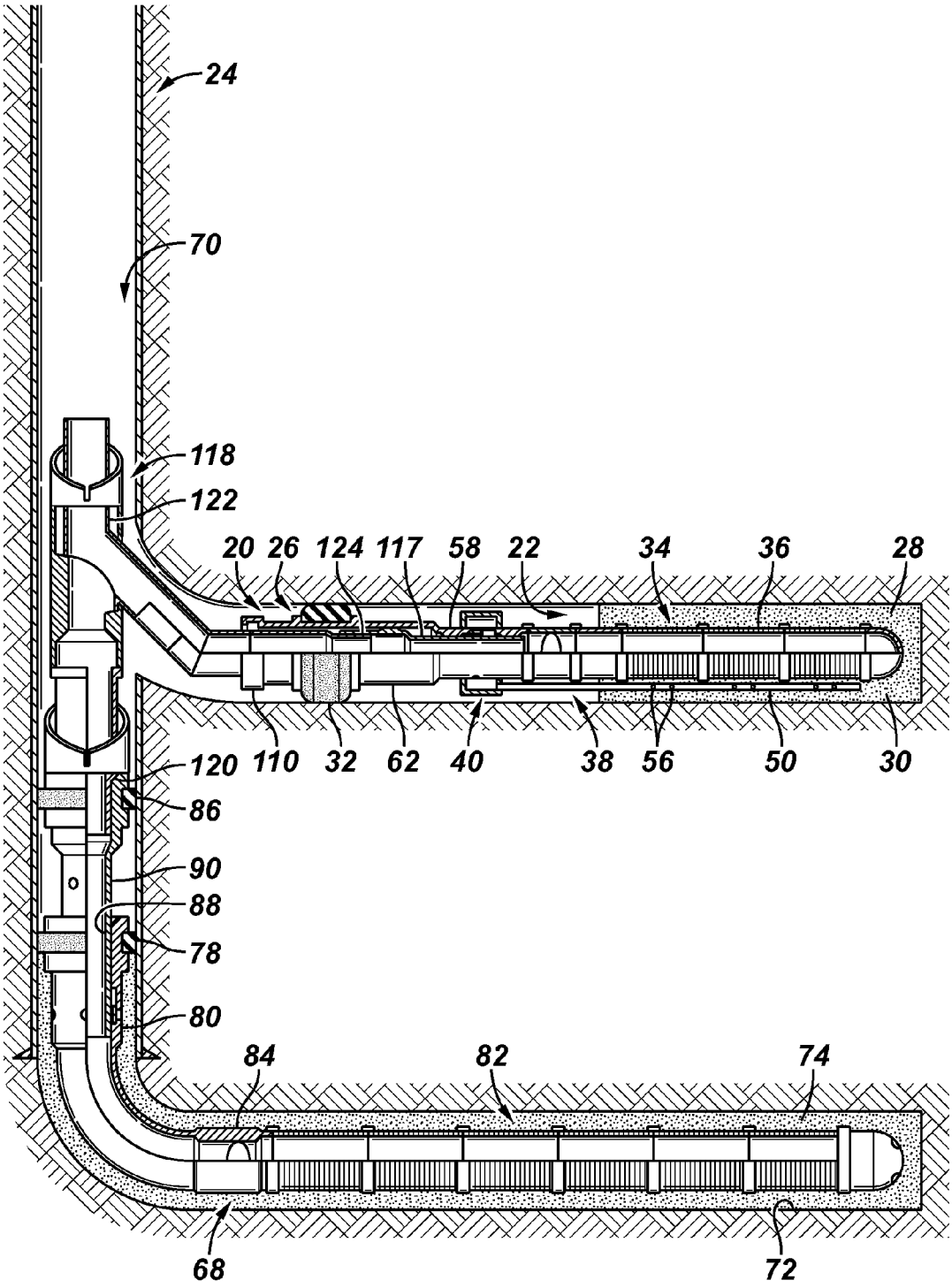
FIG. 13 illustrates a subsequent phase of the gravel packing procedure and preparation of the well for production, according to an embodiment of the present invention.

A connector assembly 122 is then run in hole for engagement with the template assembly and the lateral wellbore completion 26, as illustrated in FIG. 13. By way of example, the connector assembly 122 may be run in hole in brine. The connector assembly 122 is run with a seal assembly 124, e.g. a 5 inch seal assembly, spaced out to form the sealed connection with the lateral wellbore completion 26. The running tool 98 is landed and the correct orientation of connector assembly 122 is mechanically verified. The method of testing the junction formed by connector assembly 122 may be selected depending on equipment requirements and large bore flapper valve specifications. For example, the tests may comprise drop ball tests, check valve tests, and/or pressure tests against the large bore flapper valve.

In one example of connector assembly placement, circulation is slowly started and the running tool is sheared down. The connector assembly 122 is then stroked into the template 118. A pressure signal followed by a bleed off may be used to indicate a properly sealed stab into the polished bore receptacle 58. When the connector assembly 122 is fully stroked, the string takes weight and circulation stops. The newly formed junction is then pressure tested at the required pressure, and the running tool 98 is released to allow initiation of the pull out of hole procedure.

Figure 14:
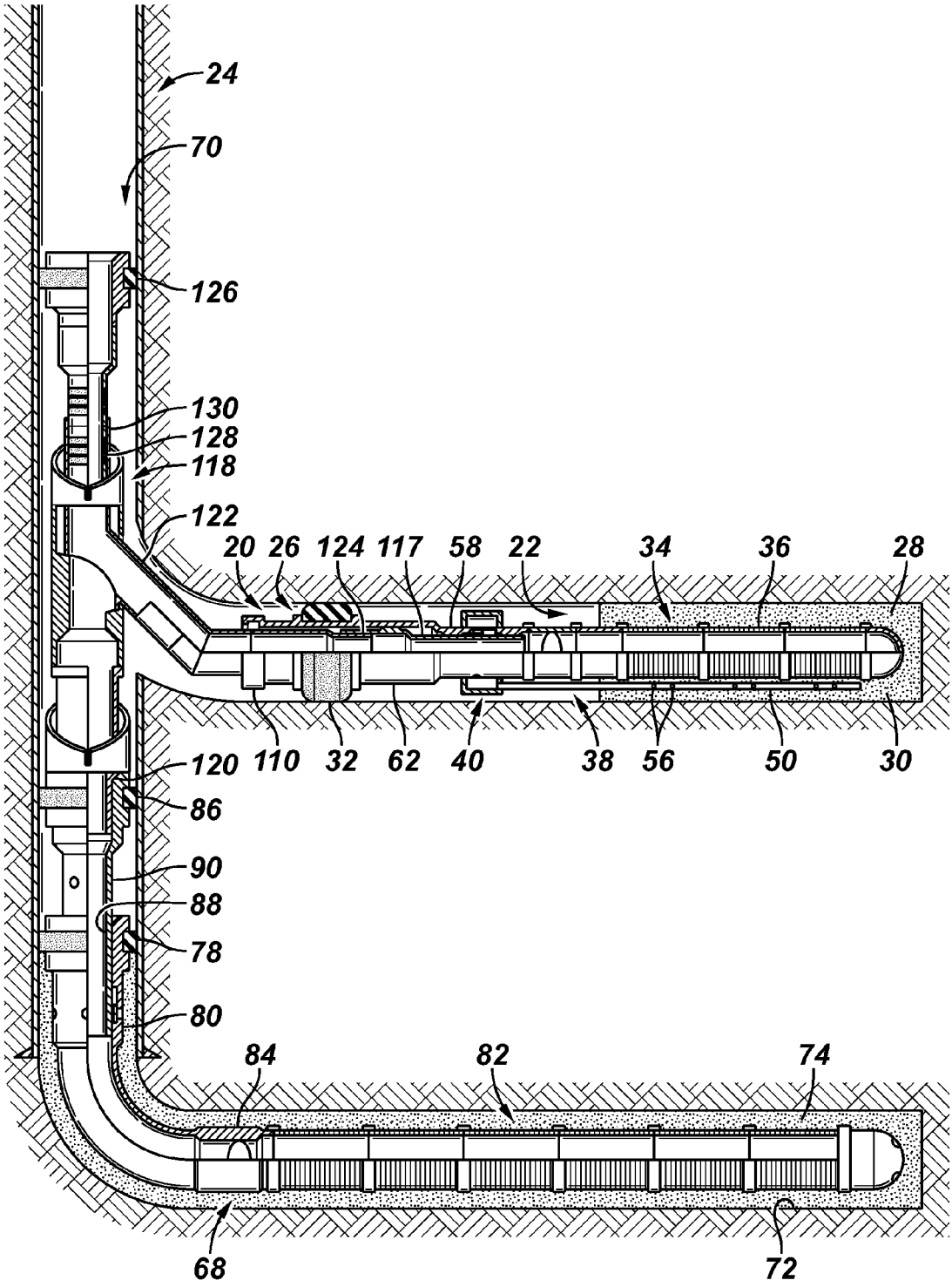
FIG. 14 illustrates a subsequent phase of the gravel packing procedure and preparation of the well for production, according to an embodiment of the present invention.
Figure 15:
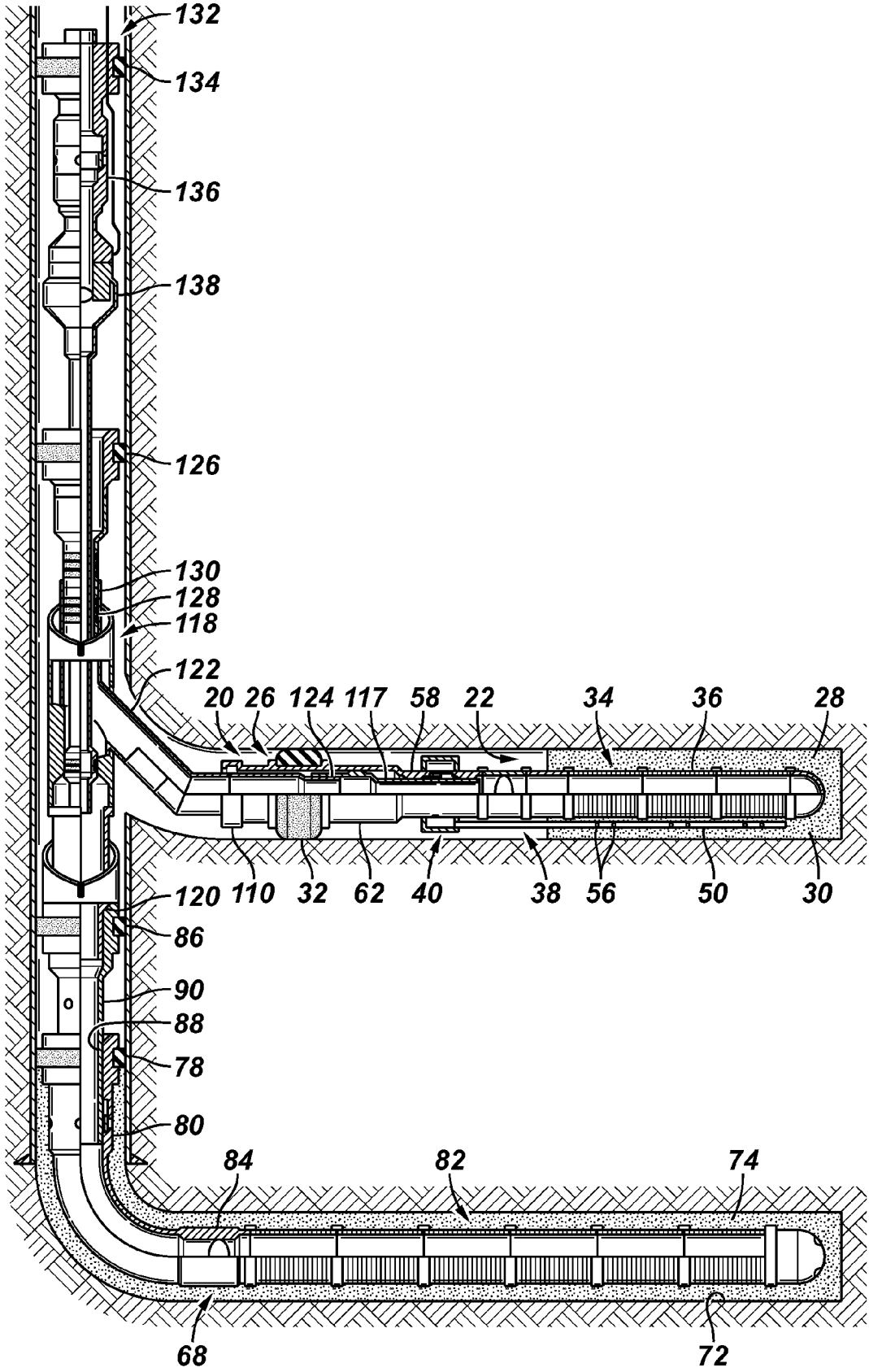
FIG. 15 illustrates a subsequent phase of the gravel packing procedure and preparation of the well for production, according to an embodiment of the present invention.

As illustrated in FIG. 14, a production packer 126, coupled to a seal assembly 128, is then run in hole until seal assembly 128 engages the connector assembly 122. At depth, pumping is initiated slowly. A pressure increase may be used to indicate that the seal assembly 128 has properly stabbed into a corresponding polished bore receptacle 130. If a proper seal has been established, the pumping is stopped. A ball is then dropped and pressure is increased to set the production packer 126. The packer 126 may then be pressure tested from the backside and, once confirmed; the running tool 98 is released and pulled out of hole. It should be noted that other types of seals, seal assemblies, and packers may be employed in alternate applications.

Subsequently, an upper completion assembly 132 is run in hole and engaged with production packer 126 in cased wellbore 70. By way of example, the upper completion assembly 132 may comprise a multiport packer 134, an annular flow control valve assembly 136, and an in-line flow control valve assembly 138. Once in position, both valve assemblies 136, 138 are closed and packer 134 is set. Fluid is swapped above the packer 134 by an appropriate mechanism. The in-line flow control valve assembly 138 and formation isolation valve 84 are then opened by a pressure cycle so the lower zone may be tested and cleaned before closing the flow control valve assembly 138. The annular valve assembly 136 is then opened and the flapper valve is confirmed as open. The upper zone, e.g. upper lateral wellbore zone, is then tested and cleaned. The in-line flow control valve assembly 138 is then opened and both the lower and upper lateral wellbores are ready for production. It should again be noted, that the flow control valve assemblies 136, 138, and the overall design of upper completion assembly 132 may vary substantially between different environments and different types of production applications.

The overall well system is designed to accommodate a variety of completion arrangements in many types of well environments. Accordingly, the number, type and configuration of components and systems within the overall system may be adjusted to accommodate different applications and environments. The number of lateral wellbores also may vary, and additional upper lateral wellbores may be drilled and completed according to the techniques described above. Furthermore, the components of the alternate path system may be adjusted; additional or alternate completion components may be employed; and a variety of running tools and gravel pack service tools may be used to carry out the gravel packing and production applications. In the example discussed above, a Level 5 connection is formed with the lateral wellbore completion in the upper lateral wellbore. The Level 5 connection provides hydraulic isolation at the junction, however other components and designs may be employed to establish the Level 5 connection. The components also may change depending on whether the production application is focused on oil or gas.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method of gravel packing a multilateral well, comprising:

gravel packing a lower lateral wellbore;

preparing a lateral completion with a shrouded circulating housing having a flow control device which selectively controls flow of gravel slurry to an interior of the shrouded circulating housing;

providing the lateral completion with a screen section;

coupling a shunt tube with the shrouded circulating housing and positioning the shunt tube along an exterior of the screen section to provide a flow path along which the gravel slurry exits the shrouded circulating housing;

moving the lateral completion into an upper lateral, open hole wellbore positioned above the lower lateral wellbore; and introducing a gravel pack into the upper lateral, open hole wellbore through the shunt tube.

2. The method as recited in claim 1, further comprising utilizing a flapper valve to selectively allow or block flow along an interior of the screen section.

3. The method as recited in claim 1, wherein preparing comprises coupling a plurality of shunt tubes to the shrouded circulating housing.

4. The method as recited in claim 1, wherein preparing comprises preparing the lateral completion with a level 5 junction and an open hole packer.

5. The method as recited in claim 1, wherein preparing comprises preparing the shunt tube as a shunted blank pipe fitted with nozzles.

6. The method as recited in claim 1, wherein preparing comprises preparing the lateral completion with a polished bore receptacle coupled to the shrouded circulating housing.

7. The method as recited in claim 1, wherein preparing comprises preparing the screen section with a plurality of screens.

8. The method as recited in claim 1, wherein preparing comprises preparing the flow control device with a sleeve mechanism to control flow of gravel slurry into the shunt tube.

9. The method as recited in claim 1, further comprising subsequently preparing the lateral completion in an additional upper lateral wellbore and gravel packing the additional upper lateral wellbore.

10. A method of gravel packing a multilateral well, comprising:

deploying a gravel pack screen into an open hole lateral wellbore;

positioning a crossover device in the open hole lateral wellbore, the crossover device having a flow control device which selectively controls flow of gravel slurry there thru;

connecting at least one shunt tube to the crossover device such that the shunt tube is located along an exterior of the gravel pack screen, to provide a flow path along which the gravel slurry exits the crossover device;

isolating the open hole lateral wellbore with an open hole packer; and delivering a gravel slurry through the at least one shunt tube to create a uniform gravel pack in the open hole lateral wellbore.

11. The method as recited in claim 10, wherein deploying comprises the deploying the gravel pack screen into an upper open hole lateral wellbore located above a lower lateral wellbore.

12. The method as recited in claim 10, wherein the flow control device comprises positioning a shrouded circulating housing having a shroud positioned around a port closure sleeve.

13. The method as recited in claim 12, wherein connecting comprises connecting a plurality of shunt tubes to the shroud.

14. The method as recited in claim 13, wherein delivering comprises controlling the port closure sleeve to allow flow of gravel slurry into the plurality of shunt tubes.

15. The method as recited in claim 11, wherein deploying comprises running a whipstock and a mill assembly downhole through a cased primary wellbore to mill a window in the cased primary wellbore.

16. The method as recited in claim 15, wherein deploying comprises drilling the open hole lateral wellbore.

17. The method as recited in claim 16, further comprising retrieving the whipstock from the cased primary wellbore and installing a template into the cased primary wellbore.

18. The method as recited in claim 17, further comprising installing a lateral wellbore connector assembly, a production packer, and an upper completion in the cased primary wellbore and establishing a level 5 junction.

19. A system for gravel packing an upper lateral wellbore, comprising:

a wellbore completion apparatus comprising:

an open hole packer;

a shrouded circulating housing coupled to the open hole packer, the shrouded circulating housing having a flow control device which selectively controls flow of gravel slurry to an interior of the shrouded circulating housing;

a polished bore receptacle positioned in cooperation with the shrouded circulating housing;

a screen section coupled to the shrouded circulating housing on an opposite side relative to the polished bore receptacle; and an alternate path system connected to the shrouded circulating housing and extending externally of the shrouded circulating housing, the alternate path system comprising at least one shunt tube to deliver gravel slurry from the shrouded circulating housing along a path outside of the screen section into an open hole lateral wellbore.

20. The system as recited in claim 19, further comprising a large bore flapper valve position between the shrouded circulating housing and the screen section.

21. The system as recited in claim 19, wherein the at least one shunt tube comprises a plurality of shunt tubes fitted with a plurality of nozzles.

22. The system as recited in claim 19, wherein the screen section comprises a plurality of screens around which a gravel pack is formed.

* * * * *